United States Patent [19]

Cooke et al.

[11] Patent Number: 4,576,518

[45] Date of Patent: Mar. 18, 1986

[54] FIXED/MOVABLE MARINE STRUCTURE SYSTEM

[75] Inventors: William J. Cooke, Kelowna; James N. Dancey, Calgary; George B. DeBoon, Calgary; Norman W. Miller, Calgary; Glen R. Yungblut, Ottawa, all of Canada

[73] Assignee: EPI Resources Ltd., Calgary, Canada

[21] Appl. No.: 582,257

[22] Filed: Feb. 22, 1984

[51] Int. Cl.[4] ..... E02B 17/00

[52] U.S. Cl. ..... 405/205; 405/203; 405/195

[58] Field of Search ..... 405/207, 205, 224, 203, 405/204, 206, 208, 226; 114/264, 265

[56] References Cited

U.S. PATENT DOCUMENTS

| | | | |
|---|---|---|---|
| 2,931,184 | 4/1960 | D'Arcangelo | 405/224 |
| 3,081,600 | 3/1963 | Davidon | 405/208 |
| 3,412,564 | 11/1968 | McClintock | 405/208 |
| 3,589,133 | 6/1971 | Lowd | 405/205 X |
| 3,605,414 | 9/1971 | Westmoreland | 405/208 X |
| 3,736,756 | 6/1973 | Lloyd | 405/205 X |
| 4,199,275 | 4/1980 | Tuson | 405/204 X |
| 4,310,052 | 1/1982 | Rivertz | 405/203 X |
| 4,314,776 | 2/1982 | Palmer et al. | 405/203 X |

FOREIGN PATENT DOCUMENTS

| | | |
|---|---|---|
| 773815 | 12/1967 | Canada . |
| 828430 | 12/1969 | Canada . |
| 831727 | 1/1970 | Canada . |
| 892328 | 2/1972 | Canada . |
| 946631 | 5/1974 | Canada . |
| 970579 | 7/1975 | Canada . |
| 972976 | 8/1975 | Canada . |
| 984162 | 2/1976 | Canada . |
| 1032026 | 5/1978 | Canada . |

*Primary Examiner*—Dennis L. Taylor

*Attorney, Agent, or Firm*—Leydig, Voit & Mayer Ltd.

[57] ABSTRACT

A platform is provided for use in combination with a foundation affixable to a sea bed to provide a fixed/-movable marine structure system for use at selected offshore locations. The platform is capable of alternately existing in a fixed mode in which the platform is releasably coupled to the foundation, and in a floating mode in which the platform is uncoupled from the foundation. The platform comprises a working deck, and a supporting structure including buoyancy adjustment means and securing means. The buoyancy adjustment means preferably comprises ballast adjustment means. Also provided is a marine structure system comprising a platform and a foundation, and a method of coupling and uncoupling the platform from the foundation. The system of the present invention is well adapted for use at offshore locations subject to conditions which may require a platform to be both relatively rigid and stable on site at times and to be safely moved off site at other times. Such locations include areas subject to severe weather conditions and periodic intrusion of icebergs or ice floes. The platform is well adapted for use as an oil or gas production platform.

28 Claims, 10 Drawing Figures

FIXED/MOVABLE MARINE STRUCTURE SYSTEM

FIELD OF THE INVENTION

This invention relates to marine structures generally, and more particularly, to an oil or gas production and/or drilling platform, for use with a foundation affixed to the sea bed to provide a marine structure system for use at selected offshore locations. This invention also relates to a marine structure system comprising such a platform and a foundation, and to a method of coupling and uncoupling such a platform.

BACKGROUND OF THE INVENTION

Conventional oil production and/or drilling platforms fall into two broad categories, the floating platform and fixed or bottom founded platform. There are three sub-categories of fixed platforms, the pile or jacket supported type, the jack-up type, and the gravity base type.

The pile or jacket supported platform is the most common type of fixed platform. It typically comprises a deck supported above the water by a framework of columns affixed to the sea bed and coupled together by braces. The jack-up type of platform includes a buoyant deck having three or more jackable legs coupled thereto, which is floatable with its legs in a raised vertical position to a particular site. On site, the legs are lowered to the sea bed, the deck being raised above the water level by the legs. The gravity base platform generally comprises a relatively large unit, usually made of concrete, which may be floated vertically to a site and sunk to the ocean floor by ballasting. Fixed platforms are typically secured to the ocean floor by means of piles. The cross-sectional area of the base of the gravity base platform provides resistance to loading, whereas the piles of the jacket supported platform provide support for loads.

Floating platforms (also known as column stabilized platforms) come in several designs, but typically a floating platform comprises a deck supported by several large diameter columns, some of which may be interconnected by pontoons. A floating platform is generally anchored at a particular location by means of cables or chains under tension attached to anchors or permanent seafloor fixtures, or other tethering means.

Conventional platforms are not well adapted for oil production operations at offshore locations subject to conditions which may require the platform to be both relatively rigid and stable on site at times and to be safely moved off site at other times under various conditions, including adverse weather conditions. Such locations include the following: areas subject to severe weather conditions and periodic intrusion of heavy ice such as icebergs or ice floes; offshore areas controlled by politically unstable countries; and areas containing oil or gas fields of marginal commercial value.

The conventional floating platform is of course readily capable of movement off site. However, it is not well adapted for on site operations such as long term production of oil or gas, since these operations require a facility which is firmly affixed to the sea bed. Floating platforms tend to move about too much in heavy seas and during bad weather, resulting in stoppages of oil or gas production operations. Since the interruption of operations has a much more serious economic consequence in the case of oil or gas production than it does in the case of drilling, floating platforms of a type that are suitable for most drilling projects have serious limitations if used for long-term oil production operations at most locations.

The conventional jacket supported or gravity base fixed platform can be designed to be unaffected by high winds and heavy seas. However, it may be economically unwise to place a fixed platform at certain locations, such as those controlled by politically unstable countries. It is also generally not commercially viable to use a fixed platform to conduct production operations from marginal fields. Moreover, conventional fixed platforms designed and constructed to withstand wind and sea forces are generally not made to withstand forces generated by collisions with large icebergs or ice floes. Therefore, massive fixed structures that are many times larger and stronger and many times more expensive than conventional fixed structures would be required for use in iceberg infested waters.

In particular, neither conventional floating nor conventional fixed platforms are well suited for oil or gas production in a location such as the Hibernia oil field off the coast of Newfoundland, Canada, which is subject to relatively severe environmental conditions and periodic intrusion of medium to large size icebergs (height 14–46 meters above water surface, draught of 30–90 meters).

It is considered by the inventors that a production platform operating in a floating mode could not be used efficiently at Hibernia or similar locations, due to the anticipated high occurrence of production stoppages caused by actual or forecast adverse weather and sea conditions. It is also considered that a fixed structure designed to withstand relatively infrequent iceberg collisions would be financially unattractive, due to the very high capital cost of such a structure. Furthermore, it is not clear whether a fixed structure can be built to withstand the forces generated by iceberg collisions.

SUMMARY OF THE INVENTION

It has been found that the main disadvantages of using one or the other type of conventional platform in selected locations can be reduced or eliminated by a fixed/movable platform capable of supporting producing operations in fixed mode and capable of being moved off site when conditions require relocation. When such conditions (e.g. threat of iceberg collision) no longer exist, the platform can return to the site and producing activities can be resumed.

The platform of the present invention is capable of being secured or latched to the foundation in fixed mode during oil production or drilling operations. Thus it is not affected by weather and sea storm conditions as are conventional floating platforms. This arrangement also facilitates the direct access to each wellbore from the deck of the platform for routine production and workover operations. Moreover, unlike fixed platforms, the present platform may be uncoupled from the foundation and moved away from the site to avoid a potential iceberg collision, even during storm conditions. Accordingly, the platform of the present invention need not be of the enormous structural strength needed to withstand infrequent encounters with medium or large icebergs. The fixed/movable marine structure system of the present invention thus combines the enhanced resistance to storm conditions and other operational advantages of fixed structures with the mobility advantage of floating structures.

The present invention is directed to a platform for use in combination with a foundation affixable to a sea bed to provide a marine structure system for use at selected offshore locations, the platform being capable of alternately existing in a fixed mode in which the platform is releasably coupled to the foundation and in a floating mode in which the platform is uncoupled from the foundation. The platform comprises at least one working deck, and a supporting structure for supporting the one or more decks above the water when the platform is in floating mode or in fixed mode. The supporting structure includes buoyancy adjustment means for adjusting the buoyancy of the platform, and securing means. By "buoyancy of the platform" is meant the ability of the platform to float on the water, which depends upon the mass of the platform (including its load, e.g. ballast) and the amount of water displaced by the platform. The buoyancy adjustment means is capable of adjusting the buoyancy of the platform from a first pre-selected buoyancy value, correlatable with a first draught value suitable for floating mode operation, to a second pre-selected lower buoyancy value correlatable with a second greater draught value. Such an adjustment allows the base of the platform to be positioned sufficiently close to the foundation to permit conversion to fixed mode operation. The buoyancy adjustment means is also capable of adjusting the buoyancy of the platform, while the platform remains coupled to the foundation, to a third pre-selected buoyancy value greater than the second buoyancy value, correlatable with an equivalent draught which is less than the second draught value. By "equivalent draught" is meant the draught the platform would float at if it were not restrained by the securing means to the foundation. The securing means is capable of releasably engaging the foundation so as to convert the platform from floating mode to fixed mode and vice-versa, by controllably releasably rigidly coupling the platform to the foundation so as to substantially eliminate heave, pitch and roll of the platform due to sea and wind forces, and by controllably uncoupling the platform from connection with the foundation. "Heave", of course, refers to vertical movement of a floating structure, whereas "pitch" refers to a change in inclination of the bow and stern of the structure, and "roll" refers to a change in side-to-side inclination of the structure.

The buoyancy adjustment means preferably comprises ballast adjustment means for adjusting the ballast of the platform. The ballast adjustment means is capable of adjusting the ballast of the platform from a first pre-selected ballast value correlatable with a first draught value suitable for floating mode operation to a second pre-selected greater ballast value correlatable with a second greater draught value, so that the base of the platform may be positioned sufficiently close to the foundation to permit conversion to fixed mode operation, and subsequently, while the platform remains coupled to the foundation, to a third pre-selected ballast value less than the second ballast value, correlatable with an equivalent draught value less than the second draught value.

The ballast adjustment means is preferably operable to adjust the ballast of the platform to the third ballast value while the platform is coupled to the foundation, and the securing means is preferably remotely operable from the working deck for relatively quick release, so that upon release of the securing means, the platform rises rapidly and assumes an equilibrium position at a pre-selected vertical distance above the foundation following a period of damped oscillatory motion. The equilibrium distance is selected to minimize the possibility of collision by the platform during oscillatory motion thereof with the foundation or sea bed while maintaining the floating stability of the platform.

The second ballast value may be selected so that the platform is capable of descending sufficiently to enable coupling of the platform to the foundation, when the underside of the supporting structure, excluding the securing means, is spaced by a predetermined distance from and above th top surface of the foundation. Preferably, the ballast adjustment means is operable to maintain the ballast of the platform at the third ballast value during normal working operations. The equivalent draught value may be selected to be about mid-way between the first and second draught values, or substantially the same as the first draught value.

In the preferred embodiment, the platform includes self-propulsion means for maneuvering the platform in floating mode. The supporting structure of the preferred embodiment comprises four substantially vertical parallel columns rigidly connected to the four corners of the deck. The ballast adjustment means preferably comprises tanks in the columns and tanks in a pontoon making up the bottom portion of the supporting structure, and pumping means.

The securing means may comprise a plurality of hydrostatic securing means, or a plurality of mechanical latch means, the latter means including a tension rod operated by long stroke hydraulic jacks or by shorter stroke hydraulic ring-jacks.

The present invention is also directed to a marine structure system, comprising a platform as described above and a foundation, the foundation including piling means for affixing the foundation to the sea bed and coupling means for engagement by the securing means of the platform. The foundation may include buoyancy means for enabling flotation of the foundation to the selected site.

The present invention therefore provides a marine structure system for supporting drilling and producing activities connected with oil and gas fields, the system including a platform which can be affixed to a foundation in operating or producing mode, and which can be detached from the foundation in floating or standby mode. In the fixed mode, the platform and foundation structure can withstand all of the environmental forces that are expected throughout the life of the field, except those caused by the impact of large icebergs or ice floes. In the standby or floating mode, the platform is detached from the foundation and can be moved to avoid icebergs or ice floes. Furthermore, the system of the present invention is advantageous for use in areas in which icebergs or ice floes do not exist, in view of the system's ability to have the platform safely and efficiently detached from the foundation and moved away therefrom. This ability enables the system to be used under circumstances requiring the platform to be moved off site for a number of reasons; e.g. frequent dry dock type inspections or for periodic relocation due to winter ice cover. The present system can also be used to economically produce oil or gas from a field which is not sufficiently large to recover the initial investment of a platform which cannot be reused at other locations.

The present invention is further directed to a method of coupling and uncoupling a platform capable of alternately existing in a floating and fixed mode from a foundation affixed to a sea bed. The method comprises the steps of: adjusting the ballast of the platform from a first pre-selected ballast value correlatable with a first draught value suitable for floating mode operation to a second lower ballast value correlatable with a second greater draught value so as to position the base of the platform sufficiently close to the foundation to permit conversion to fixed mode operation; operating the securing means to controllably releasably rigidly couple the platform to the foundation to substantially eliminate heave, pitch and roll of the platform due to sea and wind forces; subsequently, while the platform remains coupled to the foundation, adjusting the ballast of the platform to a third pre-selected lower ballast correlatable with an equivalent draught value less than a second draught value; and operating the securing means to controllably uncouple the platform from connection with the foundation.

The invention will now be described, by way of example only, with reference to the following drawings, in which like numerals refer to like parts, and in which.

DETAILED DESCRIPTION OF THE PREFERRED EMBODIMENT

Figure 1:
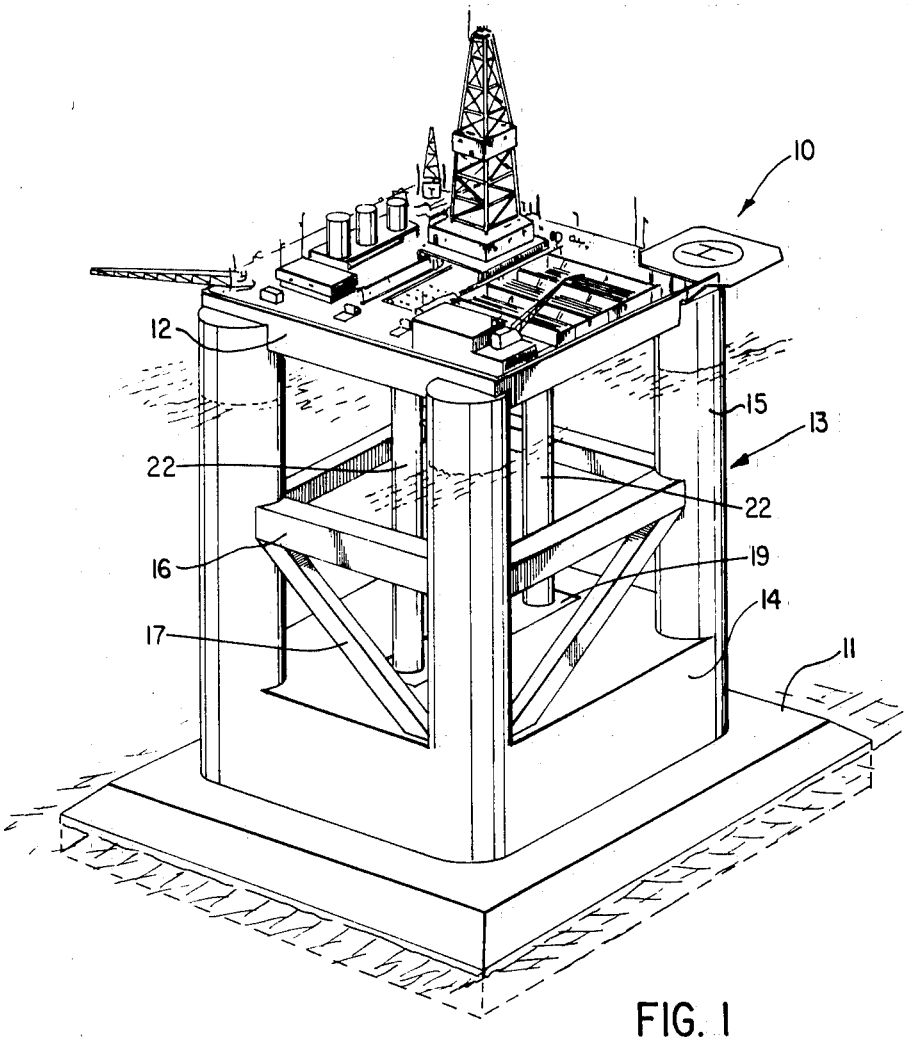
FIG. 1 is a perspective view of the preferred embodiment of the present invention, showing the platform in fixed mode coupled to the foundation.

In FIG. 1, the platform of the present invention is designated generally as 10 and is shown in fixed mode coupled to foundation 11 affixed to the sea bed at a selected location. Platform 10 is of the column stabilized type, and comprises deck 12 and supporting structure 13. Platform 10 is particularly well adapted for use as an oil or natural gas production platform, although other uses such as exploratory drilling for oil or gas, marine mining operations and the like, are conceivable.

Figure 2:
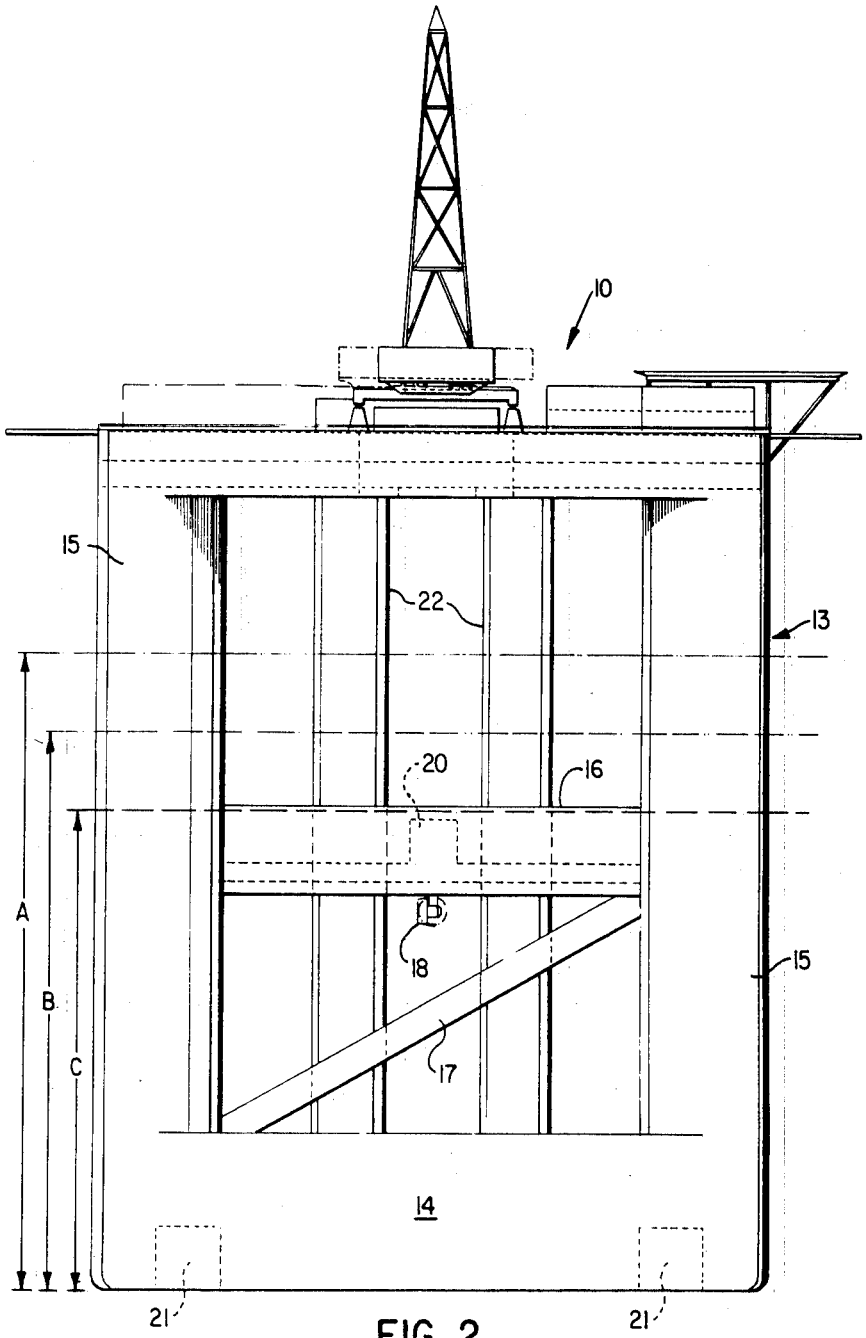
FIG. 2 is a elevational view of the preferred embodiment of the platform of the present invention.

Referring now to FIGS. 1 and 2, a pontoon 14 makes up the bottom portion of supporting structure 13. Pontoon 14 is sealed from the sea water and is provided with ballast tanks (not shown), to enable pontoon 14 to act as a buoyancy adjustment means, or more specifically, as a ballast adjustment means. The buoyancy of the platform 10 is adjusted by adjusting the mass or density of the platform, by changing the ballast (i.e. ballast level or degree of ballast) thereof. The ballast is typically adjusted by pumping water in and out of the pontoon tank, although the ballast may also be adjusted by adding or removing loads such as produced oil or on-deck equipment.

Securing means and coupling means for releasably engaging the platform to the foundation (not shown in FIGS. 1 and 2) are located on the underside of pontoon 14 and in foundation 11, respectively.

Columns 15 extend upwardly from each of the four corners of pontoon 14. Ballast tanks are also preferably included in columns 15, resulting in the buoyancy or draught adjustment means comprising columns 15 as well as pontoon 14. Columns 15 are provided at their top ends with means for welding or otherwise attaching thereto deck 12.

Supporting structure 13 also includes four horizontal bracings 16, each interconnecting adjacent columns 15, located about half-way between the top of pontoon 14 and the bottom of deck 12. Also included in supporting structure 13 are eight diagonal reinforcement bracings 17 (only two are shown in the figures) interconnecting adjacent columns. Vertical columns 22 protect the risers against damage by small chunks of ice or the like.

The overall height of supporting structure 13 must be selected to ensure that an appropriate amount of freeboard exists for both fixed and floating modes of operation; i.e. the distance between the deck and water surface must fall within an acceptable range dictated in part by stability criteria, for the entire range of possible platform draughts.

Thrusters for providing the platform with self-propulsion capability are preferably located near the center of horizontal bracings 16. Thruster propellers 18 are attached to the undersides of bracings 16, and could be retractable to protect them from ice. Thruster engine rooms 20 are located within bracings 16. The propulsive power of the thrusters may be sufficient to maneuver the platform under all conditions or it may be limited to keeping the platform under control and preventing drift into shallower water, in which case outside assistance may be required to advance platform 10 under storm conditions. If no self-propulsion means is provided, outside assistance will be required to position the platform 10 on site and to control the platform upon release from fixed mode.

Pontoon 14 preferably contains centrally located opening 19 for providing access to well head equipment and/or the sea bed. Supporting structure 13 is preferably made of structural steel, although reinforced concrete construction is possible.

Bracings 16 may include ballast tanks for adjusting the draught of the platform. Storage tanks for storing produced oil and water may be located in pontoon 14 and/or columns 15. Water ballast may be either integrated with or separated from the oil carried in pontoon 14 or columns 15. The pontoon tanks may be arranged in a number of parallel tank trains, each train consisting of several separate tanks. Ballast pump rooms 21 may be located within pontoon 14.

Figure 3:
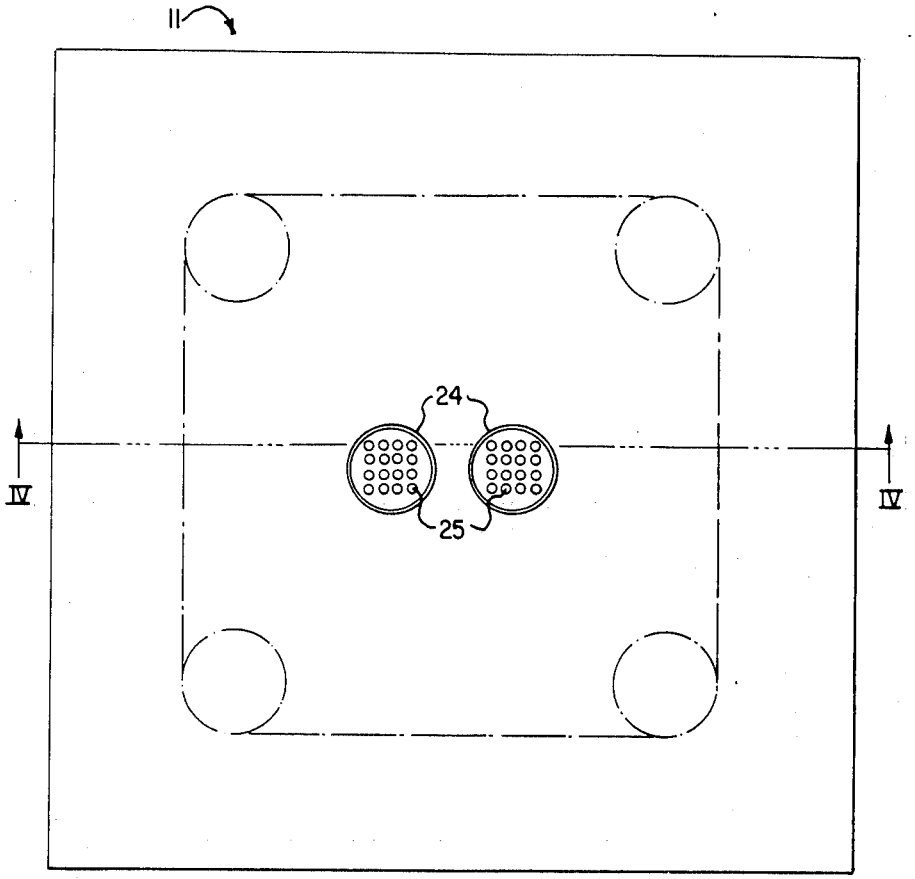
FIG. 3 is a top plan view of the preferred embodiment of the foundation of the present invention.
Figure 4:
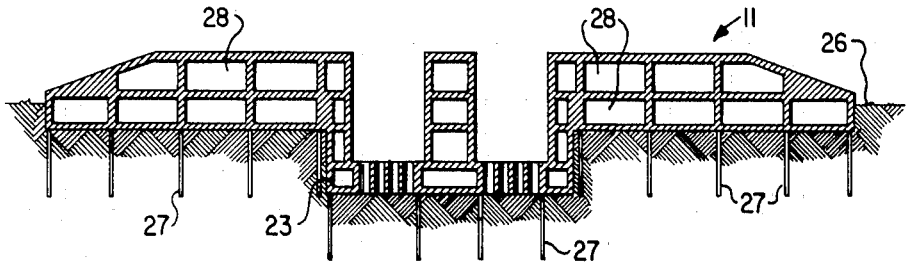
FIG. 4 is a sectional view of the foundation taken along line IV—IV of FIG. 3, showing the foundation affixed to the sea bed.

Referring now to FIGS. 3 and 4, foundation 11 is shown with a square periphery, but other shapes are possible. The edge of foundation 11 is preferably sloped as shown in FIG. 4, to help deflect the keels of icebergs. Foundation 11 may be constructed in one piece as shown in the figures or in a number of sections. For example, a circular foundation could be formed from four outside quadrant sections and a central section. As shown in FIG. 3, square foundation 11 includes openings 24 which provide access to well slots 25 and the sea bed. The dotted lines in FIG. 3 illustrate the preferred position of platform 10 when it is coupled to foundation 11.

FIG. 4 shows foundation 11 affixed to sea bed 26, which has been prepared by dredging operations or the like. The height, slope angle and embedding depth of foundation 11 will depend upon design parameters such as the size of icebergs to be encountered and maximum projected depth of iceberg scour. It may be desirable to provide the foundation with a centrally located base extension 23 to provide enhanced protection of the well-head from iceberg scour. A plurality of piles 27 may be driven through the foundation into the sea bed to provide additional resistance to lateral forces. Foundation 11 should be designed to withstand the projected storm forces (e.g. one hundred year storm forces) associated with a selected location, and also to withstand the load, shear force and moment associated with the platform when it is coupled to the foundation.

Foundation 11 may be constructed of reinforced concrete, or steel, or a combination of both materials. It is preferably provided with buoyancy chambers 28, to enable foundation 11 to be floated to the site. Once the foundation is positioned on the site, chambers 28 are ballasted to sink the foundation 11 to the sea floor.

The top surface of foundation 11 is preferably planar, and may include a number of apertures or other coupling means (not shown in FIGS. 3 and 4), dimensioned to accommodate the securing means of the platform 10 as discussed below. The foundation may also be provided with conical keys or conical indentations, for guiding the platform 10 onto the top surface of foundation 11.

Figure 5:
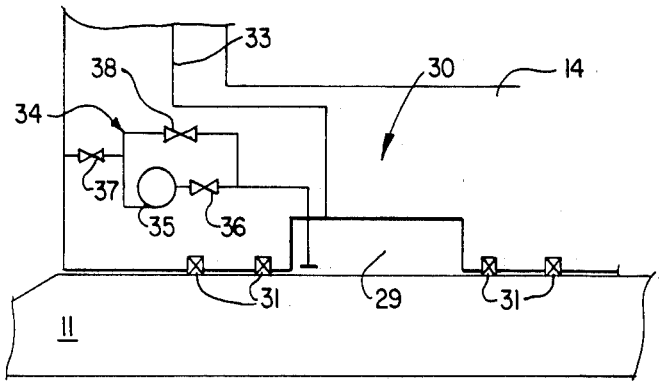
FIG. 5 is a diagrammatic representation of a hydrostatic embodiment of the securing means of the present invention.

FIGS. 5–9 illustrate various embodiments of the securing means of the present invention. FIG. 5 illustrates a hydrostatic embodiment of the securing means, which utilizes external water pressure to couple the platform 10 to the foundation 11. Hydrostatic securing means designated generally as 30 comprises a plurality of regularly spaced cavities 29 formed in the bottom on pontoon 14, which are sealed from sea water when platform 10 rests upon foundation 11, by means of dual seals 31. Cavities 29 are preferably square in cross-section, although other shapes are possible.

Hydrostatic securing means 30 includes control means comprising vent pipe 33 extending from cavity 29 to the atmosphere, selectively opening cavity 29 to the atmosphere, and pumping means 34, enabling water to be pumped in and out of cavity 29. To pump water out of cavity 29, valves 36 and 37 are opened, and pump 35 is activated, pumping water out of cavity 29, air being emitted therein through vent 33. Any water leaking through seals 31 into cavities 29 can be detected and pumped out in a similar fashion by pump 35 or by other conventional equipment. To re-admit water into cavities 29, valves 37 and 38 are opened.

Coupling between platform 10 and foundation 11 is effected by pumping water from cavities 29, when platform 10 is resting on foundation 11. The downward force exerted by the head of water on top of pontoon 14 directly above cavities 29, which are at atmospheric pressure, results in rigidly coupling platform 10 to foundation 11. To uncouple platform 10 from foundation 11, water is re-admitted into cavities 29, by opening valves 37 and 38, or alternatively, by opening valves 37 and 36 and pumping the water into cavities 29. Vent pipe 33 and pumping means 34 can be operated remotely from deck 12.

The flat top surface of foundation 11 provides the coupling means for engaging the hydrostatic securing means of the platform. If it is desired to place platform 10 relative to foundation 11 with precision, guiding means in form of conical keys and appropriately dimensioned key receiving means can be provided in foundation 11 and platform 10 respectively, or vice-versa. The guiding means may be incorporated into cavities 29 by providing the cavities with conical sides.

In an alternative embodiment, the bottom of pontoon 14 is planar, and foundation 11 is provided with cavities analogous to cavities 29. In this alternative embodiment, the securing means of the platform is the flat bottom surface of the pontoon, and the coupling means are the cavities of foundation 11.

Figure 6:
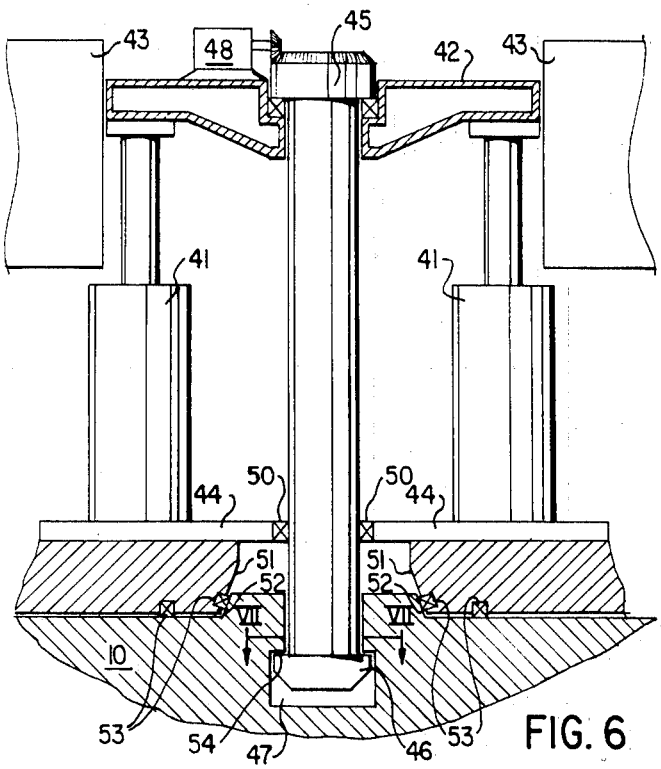
FIG. 6 is a diagrammatic representation of a mechanical embodiment of the securing means and coupling means of the present invention.

A mechanical embodiment of the securing means and the coupling means of the present invention is shown in FIG. 6. Mechanical latch means designated generally as 40 comprises a plurality of long stroke hydraulic cylinders 41 coupled to yoke 42, which is slidably engaged between guiding structures 43 and between guiding structures 44. Yoke 42 carries cylindrical tension rod 45 which is provided with claw 46 at its end remote from yoke 42, claw 46 being configured to be releasably secured in coupling means 47 provided in the top surface of foundation 11. Cylinders 41 are mounted on guiding structures 44, which are rigidly attached to platform 10.

The top end of tension rod 45 is provided with gear means for enabling rotation of rod 45 by motor and gear means 48. Flexible seals 50 are provided between guiding structures 44 and tension rod 45. Inflatable seals 53 may be provided at the bottom of platform 10.

Platform 10 includes conical keys 51 dimensioned to be received within alignment depression 52 provided in the surface of foundation 11, to facilitate alignment of tension rod 45 with coupling means 47. Latch means 40 is capable of remote operation from deck 12.

Figure 7:
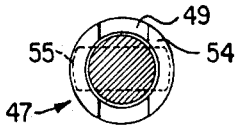
FIG. 7 is a sectional view of the mechanical embodiment of the coupling means taken along line VII—VII in FIG. 6.

As shown in FIGS. 6 and 7, claw 46 may be slot-shaped, and coupling means 47 may be an aperture having a top portion circular in cross-section and dimensioned to slidably engage cylindrical tension rod 45, and having a bottom portion of circular cross-section of larger diameter to accept claw 46. The interface between the upper portion and bottom portion is defined by shoulder 54 having a slot shape opening 49 therethrough, such that tension rod 45 may be engaged within coupling means 47 by inserting claw 46 through the slot shaped opening 49 beyond shoulder 54 and rotating rod 45 by about 90°, to assume position 55 shown by the dotted lines in FIG. 9.

Mechanical latch means 40 is operable not only to rigidly couple platform to the foundation, but also to pull the platform towards the foundation, once the ballast of the platform is adjusted to position it to within one or two meters from the top of the foundation, depending upon the stroke length of rod 45. This pulling action is accomplished by collapsing hydraulic cylinders 41 to extend tension rod 45 towards the foundation, rotating tension rod 45 to align claw 46 with slot shaped opening 49, collapsing cylinders 41 further or reducing the buoyancy of the platform further to insert claw 46 beyond shoulder 54, and rotating claw 46 about 90° to assume position 55. Hydraulic pressure is then applied to cylinders 41 to extend same, thus drawing platform 10 into physical contact with foundation 11. Coupling is preferably done during good weather conditions, but may be done as long as wind conditions permit maneuverability and heave is sufficiently low.

Once coupling is effected, the ballast of platform 10 is decreased, by deballasting the tanks in pontoon 14 and/or columns 15, resulting in platform 10 being coupled by tension forces to foundation 11. It is preferable that the ballast of the platform 10 be so adjusted at all times during normal working operation, although such adjustment could be deferred as discussed below.

Once the platform 10 is deballasted to achieve a desired equivalent draught, platform 10 may be uncoupled by depressurizing hydraulic cylinders 41, and then rotating claw 46. Cylinders 41 are designed to collapse at a rate faster than the rate at which the deballasted platform 10 rises, enabling disengagement of claw 46 under substantially zero force conditions. To increase the release rate of cylinders 41, such cylinders may be double stroke hydraulic cylinders. It may be necessary to inject water under platform 10 by means of a jetting system to eliminate the effect of hydrostatic head and to allow the rising of the platform after release.

If desired, platform 10 may be provided with a plurality of both mechanical means 40 and hydrostatic securing means 30. In one such combination, mechanical latch means 40 could be utilized only to pull platform 10 towards foundation 11, the hydrostatic securing means thereafter providing the coupling force.

Figure 8:
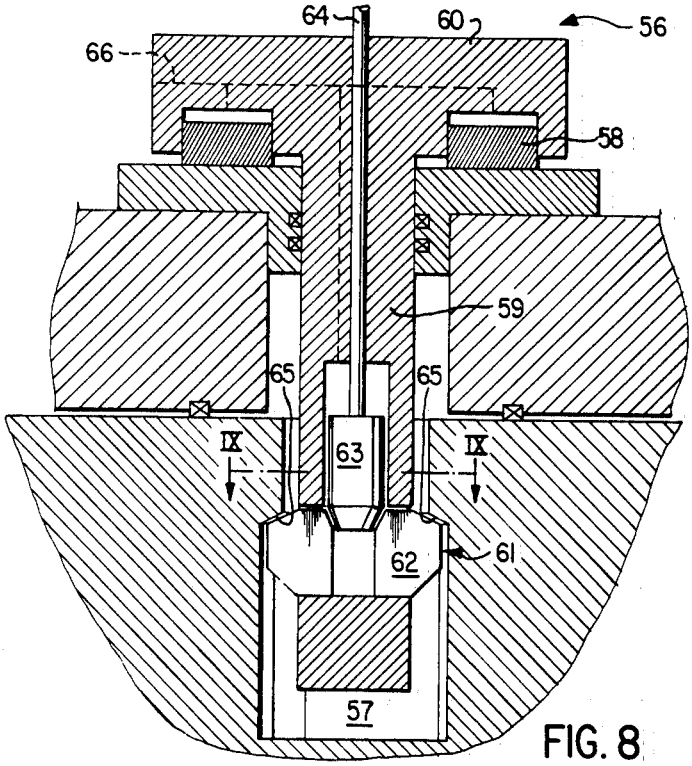
FIG. 8 is a diagrammatic representation of an alternative mechanical embodiment of the securing means and coupling means of the present invention.

Referring now to FIG. 8, an alternative mechanical embodiment of the securing means and coupling means of the present invention is remotely operable ring-jack latch means designated generally as 56 and coupling means 57. It comprises relatively short stroke hydraulic ring-jack 58, tension rod 59 having integral yoke 60 at one end and at the other end quick release engagement means 61 including locking shoes 62, locking piston 63, locking shaft 64 slidably engaged within rod 59 along the longitudinal axis thereof, and hydraulic fluid line 66. Foundation 11 is provided with coupling means 57, which is an aperture dimensioned and configured to accommodate the bottom end of rod 59 including locking shoes 62.

As shown in FIG. 8, latch means 56 is in its coupled or engaged position. To disengage, locking shaft 64 is displaced upwardly, moving locking piston 63 out of engagement with locking shoes 62, allowing same to retract back into the body of rod 59 out of engagement with shoulder 65 of coupling means 57. To re-engage, shaft 64 is displaced downwardly, causing piston 63 to bear against and extend locking shoes 62, which are suitably tapered to enable slidable retraction and extension.

Figure 9:
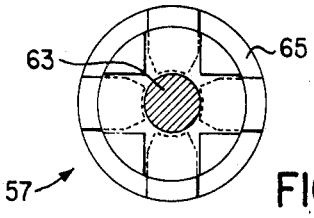
FIG. 9 is a sectional view of the alternative mechanical embodiment of the coupling means, taken along lines IX—IX in FIG. 8.

FIG. 9 shows the cross-section configuration of coupling means 57, which comprises an upper cylindrical portion, and a lower portion cruciate in cross-section, dimensioned to accommodate a rod 59 having four locking shoes 62 oriented 90° apart. No rotation of rod 59 is required to effect coupling and decoupling.

Engagement means 61 other than that shown comprising locking shoes 62 can be provided at the end of rod 59, but such means should be designed for relatively quick release, to ensure quick disconnection time, since ring-jack latching means 58 operates relatively slowly.

Relatively few ring-jack latch means 56 are required to secure the platform to the foundation, since very large tension forces can be generated with conventional ring-jack designs. However, since ring-jacks 58 are of relatively short stroke, latch means 56 is not adapted to pull platform 10 any substantial distance towards foundation 11. Accordingly, platform 10 must be resting on or closely adjacent foundation 11 before latch means 56 can be operated. Of course, it is possible to provide platform 10 with a number of units of mechanical latch means 40 and a number of units of ring-jack latch means 56, means 40 providing pulling capability. It is also possible to provide the platform with both ring-jack latch means 56 and hydrostatic securing means 30, if a hybrid hydrostatic-mechanical securing system is desired.

Modular construction techniques will most probably be required in constructing embodiments of the present invention suitable for use at Hibernia and other relatively deep offshore locations. It may, for example, be desirabe to construct pontoon 14 in two U-shaped half portions, and columns 15 in three sections. It will also most probably be necessary to assemble the component parts in floating condition, welding to take place in a submerged welding tunnel. The mating of the deck 12 to supporting structure 13 is preferably done in a sheltered site of having a water depth greater than the height of platform 10 when completed. Support from a crane barge, supply vessels and tow vessels will be required.

When adapted as an oil or gas production platform, the platform may be provided with suitable riser systems contained within columns 22 for connection with well heads. Such systems preferably include well head coupling and uncoupling means located adjacent the sea floor. Columns 22 may be dispensed with, if enhanced riser protection is not required. Risers may extend up through one or more of columns 15, instead of columns 22, if desired. If so, the risers may be directed from a centrally located well-head a distance horizontally through either the foundation 11 or pontoon 14, then vertically through one of columns 15. Alternatively, the well-head may be placed directly under one of columns 15, avoiding the need to redirect the risers. The risers may be supported in the pontoon 14 so that when they are disconnected they can be locked into the pontoon and so will not need to be pulled to the deck.

In operation, platform 10 may be floated in an upright position to a selected location. Relocation of platform 10 is preferably done during favourable weather conditions, with outside assistance, if necessary. Foundation 11 is towed in floating condition to the same location, then ballasted and sunk to the ocean floor. Alternatively, foundation 11 may be pre-coupled to platform 10 by the latch means, and lowered to the sea bed together with platform 10. Wells may be drilled before or after the foundation is put in place.

In the case of a platform designed for Hibernia, where the water depth is about 80 meters, the ballast of the platform is preferably adjusted during floating or standby mode to a first or floating ballast value, to cause the platform to float at a draught (i.e. distance between surface of water and bottom of platform) of about 50–55 meters. The first or floating ballast value of the platform may also be selected to a somewhat lower loaded value, corresponding to a draught in the range of 60–65 meters, without creating stability problems.

To convert the platform from floating to fixed mode, ballast is added, to increase the ballast of the platform from its first value to a greater second or coupling value corresponding to a second draught value equal to or slightly less than the distance between the water surface and the top of the affixed foundation. Ballast is added by pumping water into tanks in one or more of pontoon 14, columns 15 or bracings 16. The selection of the second draught value will depend upon the depth of the water, the particular type of securing means used, and whether it is desired to set the platform directly on the foundation, or to float it just above the top surface of the foundation. If the securing means includes pulling capacity as does mechanical latch means 40, the platform is preferably floated just above (e.g. 1 or 2 meters) the top of the foundation, and then pulled towards and latched to the foundation. Otherwise, the platform is set on the foundation and then secured or latched thereto. The securing operations are described above in some detail.

The ballast of the latched platform is then reduced to a third or operating ballast value less than the second value, while the platform remains coupled to the foundation, by pumping water out of the ballast tanks or otherwise suitably deballasting the platform. Oil production or other operations may then be carried out in fixed mode without interference from wind or sea forces, since securing the platform to the foundation eliminates the heave, pitch and roll associated with the floating platforms.

If the platform is pre-deballasted as just described, operation of the securing means to uncouple the platform from the foundation results in the platform rising a pre-selected distance above the foundation, without the need to perform any post-release deballasting operations.

Pre-deballasting the platform results in a relatively fast rise time, viz. the elapsed time between releasing the securing means and the platform rising a pre-specified distance above the foundation. A fast rise time reduces the possibility of damage to the platform or foundation due to heave, as the platform separates from the foundation. Pre-deballasting also increases the chances of being able to convert the platform to floating mode in emergency conditions such as loss of power, since the platform will still rise even if the deballasting pumps are rendered inoperative. A fast rise time also increases the probability of avoiding imminent collisions with late-sighted icebergs, in the case of a platform being situated in iceberg infested waters.

The ballast of the platform is preferably adjusted to the third ballast value during normal working operations. Alternatively, the deballasting of the platform to the third ballast value could be delayed until conditions warrant it, such as just prior to depletion of a marginal field, at the onset of political instability or at the beginning of iceberg season. Deballasting may be further delayed until the actual sighting of an iceberg or other floating threat, if the platform is provided with high-speed deballasting pumps of sufficient capacity to adjust the ballast of the platform to the third ballast value before relocation is required.

The third ballast value preferably corresponds to an equivalent draught value of about 70 meters, in the Hibernia case, so that the platform rises about 10 meters following decoupling. As indicated in FIG. 2, distance C is the first or floating draught value, distance B is the equivalent draught valve, and distance A is the second or operational draught value.

Figure 10:
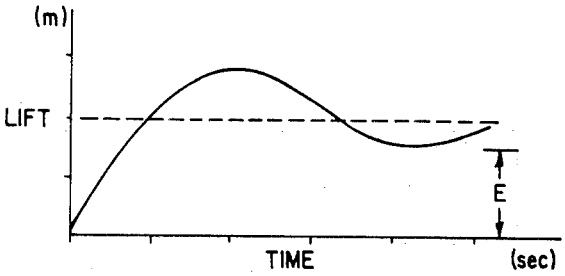
FIG. 10 is a graph illustrating the approximate expected oscillatory motion of the platform relative to the sea bottom following uncoupling, for the Hibernia case.

FIG. 10 is a rough approximation of the projected damped oscillatory motion of one embodiment of the present invention dimensioned for use at Hibernia, upon release from the foundation. Platform lift is shown as a function of time. The difference between the equivalent draught value and the second draught value must be selected to ensure that the platform, after overshooting its equilibrium draught value, does not recontact the foundation. The equilibrium draught value must also be selected keeping in mind that the movement of the platform after release must be controlled and stable. In the Hibernia case, wherein the difference between the third and second ballast values may be selected to correspond to a 10 meter increase in draught, it is expected that the platform will overshoot its equilibrium distance (shown by the dashed line) after about ten seconds, and that it will oscillate to within a distance E from the foundation of no less than about 7 to 8 meters.

A heeling angle of about 4° can be tolerated by the preferred embodiment during disconnection in severe weather conditions. Preferably, thrusters will be activated to reduce maneuvering problems at disconnection, although control from outside sources can be utilized if no self-propulsion means is provided. After the platform is uncoupled, it may be maneuvered out of the path of the iceberg by its self-propulsion means, or it may be towed to safety by a vessel. Platform 10 may be subsequently recoupled to foundation 11 in due course. After production of a particular oil field has ceased, or for any other reason, platform 10 may be moved to another location of approximately the same water depth, but foundation 11 is non-recoverable or not easily recoverable.

Of course, numerous alternative embodiments of the present invention are possible and within the scope of the present invention. The following are just a few examples. Various bracing configurations of supporting structure 13 other than those shown and described are possible. The supporting structure can comprise more or less than four columns. If the ballast tanks are incorporated into the columns, pontoon making up the base of the platform could be dispensed with. Supporting structure 13 could assume an hour-glass shape. The buoyancy of platform 10 could conceivably be adjusted without adjusting the ballast level; e.g. by changing the volume of under-water portions of supporting structure 13, causing the buoyant force exerted on the platform by the water to change. As examples, floats might possibly be releasably coupled to columns 15 at underwater locations; or columns 15 might be designed to be of variable length.

Furthermore, while the present invention has been described and illustrated with respect to the preferred and alternative embodiments, those skilled in the art will appreciate that numerous other variations of the preferred embodiment may be made without departing from the scope of this invention, which is defined in the appended claims.

We claim:

1. A platform for use in combination with a foundation affixable to a sea bed to provide a marine structure system for use at selected offshore locations, said platform being capable of alternately existing in a fixed mode in which the platform is releasably coupled to the foundation, and in a floating mode in which the platform is uncoupled from the foundation, said platform comprising:

at least one working deck; and a supporting structure for supporting the deck above the water when the platform is in floating mode or in fixed mode;

said supporting structure including:

buoyancy adjustment means capable of adjusting the buoyancy of the platform from a first pre-selected buoyancy value correlatable with a first draught value suitable for floating mode operation to a second pre-selected lower buoyancy value correlatable with a second greater draught value, so that the base of the platform may be positioned sufficiently close to the foundation to permit conversion to fixed mode operation, and subsequently, while the platform remains coupled to the foundation, to a third pre-selected buoyancy value greater than the second buoyancy value, correlatable with an equivalent draught value less than the second draught value; and securing means for releasably engaging the foundation so as to convert the platform from floating mode to fixed mode and vice-versa, by controllably releasably rigidly coupling the platform to the foundation to substantially eliminate heave, pitch and roll of the platform due to sea and wind forces, and by controllably uncoupling the platform from connection with the foundation;

wherein the securing means is capable of keeping the platform coupled to the foundation when the buoyancy value of the platform is equal to said third pre-selected buoyancy value.

2. A platform for use in combination with a foundation affixable to a sea bed to provide a marine structure system for use at selected offshore locations, said platform being capable of alternately existing in a fixed mode in which the platform is releasably coupled to the foundation, and in a floating mode in which the platform is uncoupled from the foundation, said platform comprising:

at least one working deck; and a supporting structure for supporting the deck above the water when the platform is in floating mode or in fixed mode;

said supporting structure including:

ballast adjustment means capable of adjusting the ballast of the platform from a first pre-selected ballast value correlatable with a first draught value suitable for floating mode operation to a second pre-selected greater ballast value correlatable with a second greater draught value, so that the base of the platform may be positioned sufficiently close to the foundation to permit conversion to fixed mode operation, and subsequently, while the platform remains coupled to the foundation, to a third pre-selected ballast value less than the second ballast value, correlatable with an equivalent draught value less than the second draught value; and securing means for reasonably engaging the foundation so as to convert the platform from floating mode to fixed mode and vice-versa, by controllably releasably rigidly coupling the platform to the foundation to substantially eliminate heave, pitch and roll of the platform due to sea and wind forces, and by controllably uncoupling the platform from connection with the foundation;

wherein the securing means is capable of keeping the platform coupled to the foundation when the ballast value of the platform is equal to said third pre-selected ballast value; and wherein the securing means comprises remotely operable, quick release securing means remotely operable from the working deck for relatively quick disengagement of the platform from the foundation.

3. The platform as recited in claim 2, wherein said third ballast is pre-selected so that upon release of the securing means, the platform rises rapidly and assumes an equilibrium position at a pre-selected vertical equilibrium distance above the foundation following a period of damped oscillatory motion, the equilibrium distance being selected to minimize the possibility of collision by the platform during oscillatory motion thereof with the foundation or sea bed, while maintaining the floating stability of the platform.

4. A platform as recited in claim 3, wherein the second ballast value is selected so that the ballast adjustment means is operable to adjust the ballast of the platform to enable the platform to descend sufficiently to effect coupling of the platform to the foundation when the underside of the supporting structure, excluding the securing means, is spaced by a predetermined distance from and above the top surface of the foundaton.

5. A platform as defined in claim 3, wherein the ballast adjustment means is operable to maintain the ballast of the platform at said third ballast value during normal working operations.

6. A platform as recited in claim 3, wherein the third ballast value is selected such that the equivalent draught value is about mid-way between the first and second draught values.

7. A platform as recited in claim 3, wherein the third ballast value is selected such that the equivalent draught value is substantially the same as the first draught value.

8. A platform as recited in claim 3, wherein the deck substructure further comprises self-propulsion means for maneuvering the platform in floating mode.

9. A platform as defined in claim 3, wherein the deck is a box-like structure, and wherein the supporting structure comprises four parallel substantially vertical columns rigidly connected to the corners of the deck, and substantially horizontal bracings interconnecting adjacent columns.

10. A platform as defined in claim 3, wherein the ballast adjustment means comprises ballast tanks located in a pontoon making up the base portion of the supporting structure, and pumping means for ballasting and deballasting the tanks.

11. A platform as defined in claim 9, wherein the ballast adjustment means comprises tanks in the columns and tanks in a pontoon rigidly attached to the bases of the four columns, and pumping means for deballasting and ballasting the tanks.

12. A platform as recited in claim 3, wherein the securing means comprises a plurality of hydrostatic securing means.

13. A platform as recited in claim 12, wherein each of said hydrostatic securing means comprises a cavity formed in the bottom surface of the supporting structure, pumping means for pumping water in and out of said cavities, venting means for venting the cavities to the atmosphere, and sealing means for sealing the cavities against water leakage between the bottom surface of the deck structure and the top surface of the foundation.

14. A platform as recited in claim 3, wherein the securing means comprises a plurality of mechanical latch means attached to and extensible from the underside of the supporting structure.

15. A platform as recited in claim 14, wherein each of said mechanical latch means comprises a tension rod having at one end engagement means dimensioned to releasably fit within a latch coupling means located in the surface of the foundation.

16. A platform as recited in claim 15, wherein the mechanical latching means comprises a hydraulically operable rotatable tension rod having an engagement means in the form of a claw, and at least two long-stroke hydraulic cylinders attached to the supporting structure of sufficient length to enable the latching means to pull the platform when spaced close to the foundation into contact with the foundation when the claw is engaged in the latch coupling means.

17. A platform as recited in claim 15, wherein the mechanical latch means comprises a tension rod operable by hydraulic ring-jack means attached to the supporting structure, and wherein the engagement means is a quick release engagement means having locking shoes retractable into the tension rod and operable by a locking shaft slidably engaged within the tension rod.

18. A platform as recited in claim 3, wherein the platform is an oil or gas production platform comprising a deck suitable for oil or gas production operations and riser means releasably coupleable to the well head or subsea manifold system locatable below the top surface of the foundation.

19. A marine structure system, comprising a platform as recited in claim 1, and a foundation, said foundation comprising piling means for affixing the foundation to the sea bed, and coupling means for engagement by the securing means of the platform.

20. A marine structure system, comprising a platform as recited in claim 2, and a foundation, said foundation comprising piling means for affixing the foundation to the sea bed, and coupling means for engagement by the securing means of the platform.

21. A marine structure system as recited in claim 20, wherein the foundation further comprises buoyancy means for enabling flotation of the foundation to the selected site and for ballasting the foundation so that the foundation may be located on the sea bed.

22. A marine structure system as recited in claim 20, wherein the foundation includes keying means for guiding the platform onto the foundation.

23. A marine structure system as defined in claim 20, wherein the foundation has a sloped edge for assisting in deflecting iceberg keels.

24. A marine structure system as defined in claim 23, wherein the foundation has a square periphery.

25. A method of coupling and uncoupling a platform capable of alternately existing in floating and fixed mode to and from a foundation affixed to a sea bed, said platform comprising a working deck, a supporting structure for supporting the deck above water in floating and fixed mode, the supporting structure including ballast adjustment means and securing means, said method comprising the steps of:

(a) adjusting the ballast of the platform from a first pre-selected ballast value correlatable with a first draught suitable for floating mode operation to a second greater ballast value correlatable with a second greater draught value so that the base of the platform may be positioned sufficiently close to the foundation to permit conversion to fixed mode operation;

(b) operating the securing means to controllably releasably rigidly couple the platform to the foundation to substantially eliminate heave, pitch and roll of the platform due to sea and wind forces;

(c) adjusting the ballast of the platform while the platform remains coupled to the foundation from the second ballast value to a third pre-selected lower ballast value correlatable with an equivalent draught value less than the second draught value; and (d) operating the securing means to controllably uncouple the platform from connection with the foundation, when it is desired to relocate the platform.

26. A method as recited in claim 25, wherein the ballast of the platform is maintained at the third ballast value during normal working operations.

27. A method as recited in claim 25, wherein the ballast adjustment step includes adjusting the ballast of the platform to a second ballast value which is selected to position the platform just above the foundation, and wherein the coupling step includes operating the securing means to pull the platform towards and into contact with the foundation.

28. A platform for use in combination with a foundation affixable to a sea bed to provide a marine structure system for use at selected offshore locations, said platform being capable of alternately existing in a fixed mode in which the platform is releasably coupled to the foundation, and in a floating mode in which the platform is uncoupled from the foundation, said platform comprising:

at least one working deck; and a supporting structure for supporting the deck above the water when the platform is in floating mode or in fixed mode;

said supporting structure including:

ballast adjustment means capable of adjusting the ballast of the platform from a first pre-selected ballast value correlatable with a first draught value suitable for floating mode operation to a second pre-selected greater ballast value correlatable with a second greater draught value, so that the base of the platform may be positioned sufficiently close to the foundation to permit conversion to fixed mode operation, and subsequently, while the platform remains coupled to the foundation, to a third pre-selected ballast value less than the second ballast value, correlatable with an equivalent draught value less than the second draught value; and hydrostatic securing means for releasably engaging the foundation so as to convert the platform from floating mode to fixed mode and vice-versa, by controllably releasably rigidly coupling the platform to the foundation to substantially eliminate heave, pitch and roll of the platform due to sea and wind forces, and by controllably uncoupling the platform from connection with the foundation;

wherein the hydrostatic securing means comprises a plurality of cavities formed in the bottom surface of the supporting structure of the platform, and means for removing water from the cavities so as to keep the platform coupled to the foundation when the ballast value of the platform is equal to said third pre-selected ballast value.

* * * * *